US011084984B2

(12) United States Patent
Alvarado et al.

(10) Patent No.: US 11,084,984 B2
(45) Date of Patent: Aug. 10, 2021

(54) PROCESSES AND SYSTEMS FOR IMPROVEMENT OF HEAVY CRUDE OIL USING INDUCTION HEATING

(71) Applicant: Neotechnology LLC, Las Vegas, NV (US)

(72) Inventors: Alonso A. Alvarado, Panama (PA); Carolina Blanco, Panama (PA); Maria I. Briceño, Panama (PA); Alexandra Castro, Panama (PA); Douglas Espin, Macaracuay (VE)

(73) Assignee: NEOTECHNOLOGY LLC, Las Vegas, NV (US)

( * ) Notice: Subject to any disclaimer, the term of this patent is extended or adjusted under 35 U.S.C. 154(b) by 233 days.

(21) Appl. No.: 16/308,799

(22) PCT Filed: Jun. 9, 2017

(86) PCT No.: PCT/IB2017/000891
§ 371 (c)(1),
(2) Date: Dec. 10, 2018

(87) PCT Pub. No.: WO2017/212342
PCT Pub. Date: Dec. 14, 2017

(65) Prior Publication Data

US 2020/0308491 A1 Oct. 1, 2020

Related U.S. Application Data

(60) Provisional application No. 62/348,583, filed on Jun. 10, 2016.

(51) Int. Cl.
*C10G 9/00* (2006.01)
*H05B 6/10* (2006.01)

(52) U.S. Cl.
CPC ..... *C10G 9/007* (2013.01); *H05B 6/107* (2013.01); *H05B 6/108* (2013.01); *C10G 2300/1033* (2013.01); *C10G 2300/302* (2013.01)

(58) Field of Classification Search
CPC combination set(s) only.
See application file for complete search history.

(56) References Cited

U.S. PATENT DOCUMENTS 4,019,133 A * 4/1977 Manley ..... G01N 17/00 324/700
4,136,016 A * 1/1979 Rosensweig ..... B03C 1/32 208/134
4,292,171 A * 9/1981 Mayer ..... C10G 11/18 208/108
4,441,989 A * 4/1984 Spencer ..... C10G 9/00 208/106
4,504,377 A * 3/1985 Shu ..... C10G 9/007 208/106
5,054,420 A * 10/1991 Raghavan ..... C23C 16/455 118/715
5,543,041 A * 8/1996 Okazaki ..... C10G 67/02 210/181
6,315,972 B1 * 11/2001 Mehdizadeh ..... B01J 8/0285 204/157.46
2002/0093330 A1 * 7/2002 Crouzen ..... G01N 27/902 324/240

OTHER PUBLICATIONS

Office Action dated Jan. 23, 2021 for Colombia Application No. NC2019/0000139, 20 pages.

* cited by examiner

*Primary Examiner* — Randy Boyer
(74) *Attorney, Agent, or Firm* — Patterson Thuente Pedersen, P.A.

(57) ABSTRACT

Embodiments of the present invention include a novel continuous or semi-continuous process which results in the partial or total improvement of heavy oil. The improvement of the heavy oil is a result of thermally heating the oil at an interval where visbreaking occurs, thereby reducing a viscosity of the heavy oil. The core of the heating step occurs through a heating apparatus of the packed bed type including superparamagnetic, paramagnetic, and/or magnetic materials.

12 Claims, 6 Drawing Sheets

PROCESSES AND SYSTEMS FOR IMPROVEMENT OF HEAVY CRUDE OIL USING INDUCTION HEATING

RELATED APPLICATION

The present application is a National Phase entry of PCT Application No. PCT/IB2017/000891 filed Jun. 9, 2017, which claims the benefit of U.S. Provisional Application No. 62/348,583 filed Jun. 10, 2016, which is hereby fully incorporated herein by reference.

FIELD OF INVENTION

The present invention relates to the field of fluid handling and heat exchange, specifically the area of heavy oil improvement, transport, and in particular to the area of heavy oil recovery, but not excluding the partial or total improvement through the method of visbreaking.

BACKGROUND OF THE INVENTION

Visbreaking is a non-catalytic thermal method used in industry as a way to improve heavy oils through the change of the local or overall temperature of the oil within a specific range. Within said temperature range, hydrocarbon chains of varying lengths break as a consequence of the change in internal energy as well as other intrinsic chemical processes that oil undergoes as a consequence of this operation, thereby reducing the viscosity of the oil. The outcome of increasing the internal energy of a volume of heavy oil (within said range) is the partial or total improvement of the oil itself. These changes are usually reflected in the measured viscosity when the treated oil is compared to a sample of the same, before it is subject to this thermal step.

In the field of oil improvement the method of visbreaking is used as means of reducing the oil viscosity with the purpose of easing the process of transporting the crude in pipelines, oil tankers, lorry and floating barges. Oil treated through this method simplifies other downstream processes such as distillation, refining and fractioning.

The method of visbreaking is commonly practiced by pumping heavy oil through tubes circulating within an industrial oven or furnaces, or "visbreakers", that often operate at high temperatures (380° C.-560° C.). The fluid residence time within these furnaces is often greater than 5 minutes. It is common knowledge that these residence times are not sufficiently long to heat a volume of oil homogeneously to the required visbreaking temperatures. Therefore, to increase the effect of visbreaking, the oil is often moved to heated drums or vessels commonly known as "soaker drums" or "soaker".

It is difficult to control the local heating of the fluid within the tubes and it is documented that hot-spots along the tubes exist. These operating conditions and the nature of the heating mechanism allow for the generation of petroleum coke (known also as coke). These phenomena occur as a result of higher local temperatures that are above the visbreaking range. Moreover, the coke that is generated attaches to the tube walls or it is dragged with the flowing oil.

Induction heating is used in the industry as means of heating metals with the end goal of manipulating at will or simply doing heat treatments. This method is commonly performed using a power source of alternating current (AC) in low to medium frequencies 60 Hz-10 kHz and in some applications reaching high frequencies of 100 kHz-10 MHz.

The power source is connected to an induction coil made of electrically conductive material (made from metal). When the electrical current generated by the power source passes through the coil, an alternating magnetic field is generated. It is widely accepted that an electrically conductive material, placed within a region of volume wherein the magnetic field intensity is sufficiently high, is inductively heated. This induction phenomenon occurs as a result of the collapse and reinstatement of the magnetic field when it alternates its direction. Therefore, if an electrically conductive material is positioned within said alternating magnetic field, then the material will experience an alternating current which is proportional to the current passing through the induction coil, and inversely proportional to the square of the distance between them (the conductive material and the coil). The current passing through the electrically conductive material in this situation is known as an eddy current.

The magnitude of the dissipated electrical energy, in form of heat from the electrically conductive material, depends on many variables, such as, for example, the type of electrically conductive material, size and shape of the electrically conductive material, the frequency of the current generated by the power source and, therefore, the frequency of the alternating magnetic field. Other factors such as the hysteresis and electrical resistance of the electrically conductive material play an important role in the physical mechanism of heating.

When magnetic or ferromagnetic materials are separated in small parts, such as when these parts are of sizes between 1 nm-100 nm (called "nanoparticles"), the direction of magnetization can change randomly depending on the temperature that these particles are held to. The time that is required to change twice the direction of the magnetic field is known as Neel relaxation time, or Neel relaxation phenomenon. On average, these individual nanoparticles have no magnetization, although in macroscopic scales the material exhibits magnetic or ferromagnetic properties. This particular phenomenon in the branch of general physics is commonly and openly known as superparamagnetism.

Magnetic or superparamagnetic nanoparticles can be inductively heated, and the frequency of the alternating magnetic field that these nanoparticles must be subjected nominally needs to be above 100 kHz or the equivalent to surpass the Neel relaxation time. This phenomenon is different from conventional induction heating, where the frequency of said magnetic field is in the low to medium range. In the conventional case, the magnetic properties of the materials change when the temperature at which they are induced surpasses the Curie point (Curie temperature). Nevertheless, superparamagnetic or magnetic materials experience similar changes under the Curie temperature. Therefore, magnetic induction heating of metals or electrically conductive materials is different than induction heating of superparamagnetic or magnetic nanoparticles.

SUMMARY OF THE INVENTION

Embodiments of the present invention are directed to a continuous or semi-continuous process for the partial or total improvement of heavy oil by means of the method known as visbreaking. The process of implementing the temperature treatment of visbreaking described in embodiments of the present invention occurs within a packed bed type apparatus, similar to a packed-bed reactor. The heavy oil that is treated in this process is herein known as fluid or liquid and it is displaced into the process by means of pumps or other fluid handling devices. After the fluid enters the process herein described as the invention, the same is eventually in contact with a packed bed type structure. The structure can be made in the shape of spheres, irregular forms, or a mixture of both; this structure can also be in the shape of a honeycomb or an array of tightly packed hollow cylinders. Said structure has in it superparamagnetic or magnetic nanoparticles that are responsive to an alternating magnetic field, releasing energy as heat, or induction heating.

The fluid passing through the structure with a nanoparticles base is heated as a result of the thermal gradient between the packed bed surface (induction structure) and the liquid. It is due to this surface interaction that the local fluid temperature is increased until it reaches the visbreaking temperature.

Moreover, the high surface area of the induction structure allows for rapid heat exchange between the fluid and said structure. This fluid-structure interaction, as well as the known nominal energy input by the power source, allows for precise control of the process in general, and specifically of the outlet temperature of the fluid that enters the induction heating apparatus.

Afterwards, the fluid is heated within the induction apparatus, and/or the heated liquid flows to a container or series of containers that might be further heated. The fluid can either stay or move through these containers allowing it to have additional reaction residence time, if necessary. Another or additional option is to extend the length of the apparatus in order to extend the residence time.

After the liquid passes through these containers it is then moved to a cooling system or equipment for this purpose. The cooling system reduces the overall temperature of the fluid as it transits through it by means of conventional heat exchangers. This cooling step can be used to halt, hold, or slow several reactions and the breakup of long chain molecules that occur at the visbreaking temperatures. At this step is where the process of improving oil through induction heating finishes.

Once the fluid leaves the cooling step, the same can be stored, transported as it is, or mixed with a diluent stream seeking to further reduce the viscosity of the treated fluid. The fluid can be fractioned in separation units, and/or it can be handled using a mixture of one or many of the aforementioned processes.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
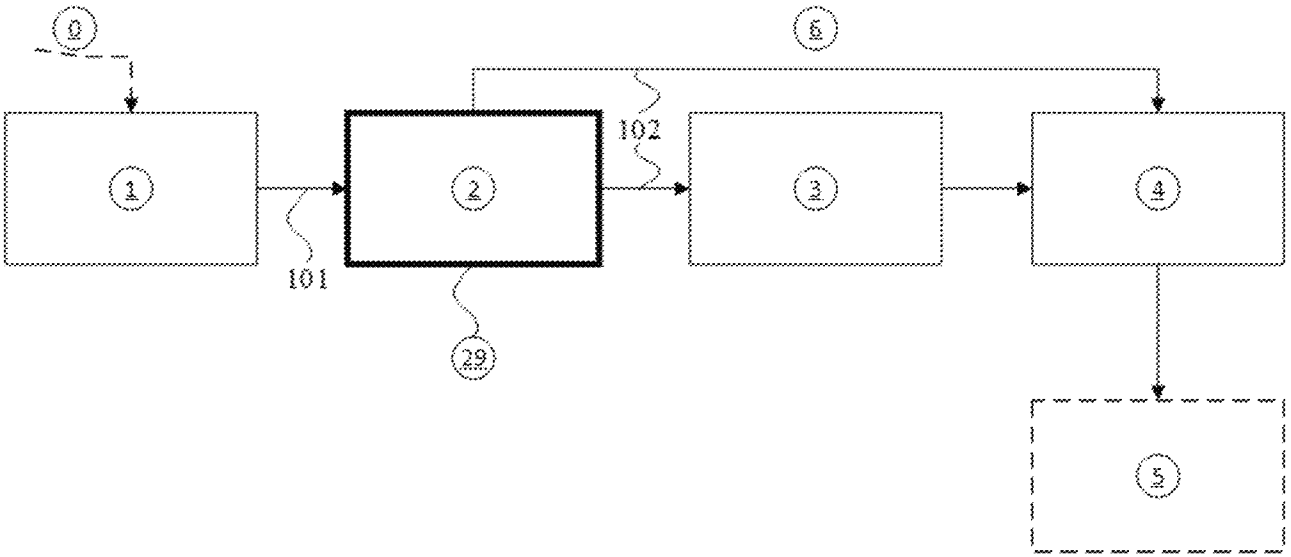
FIG. 1 is a block diagram of an induction system according to an embodiment of the present invention.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE INVENTION

The embodiments described below are not intended to be exhaustive or to limit the invention to the precise forms disclosed in the following detailed description. Rather the embodiments are chosen and described so that others skilled in the art may appreciate and understand the entire disclosure.

Embodiments of the present invention comprise one or many of the block diagrams shown in FIG. 1, in which the core of the induction heating or visbreaking is performed at section 2 of this figure. FIG. 1 shows the various general sections of an induction system according to an embodiment.

Regarding to the embodiment of the present invention, stream 0 of FIG. 1 corresponds to a process fluid feed line, such as heavy crude oil. The fluid feed can be either in continuous or semi-continuous mode according to the necessity and load of the system; the fluid is moved with the use of pumps or other fluid handling devices.

Unit 1 of FIG. 1 corresponds to a pre-heating step. Here the temperature of the fluid from stream 0 is raised by means of conventional thermal methods, such as, for example, heat exchangers, industrial furnaces, by thermal integration with other fluid streams running at higher temperatures, or by a combination of one or many of the methods hereby described.

The cold fluid feed entering at 0 displaces or exits unit 1 as hot fluid 101. In other words, by the time the fluid feed passes through unit 1 or pre-heating step, it experiences an increase in temperature such that it reaches the required process temperature before entering 2. The transfer of fluids between units is achieved using the fluid handling devices mentioned previously, or with the use of pumps, or a combination of both methods.

Once displaced outside of 1, fluid 101 passes to unit 2 comprising a heating apparatus by means of induction heating. The apparatus in unit 2 is shown in greater detail in FIG. 2 and FIG. 3. The induction apparatus comprises a cooling source 11, a power source producing an oscillating high frequency alternating current 21, an induction coil 22, a cover or casing that contains an insulating material 23, a control system 30, and other optional components.

Figure 2:
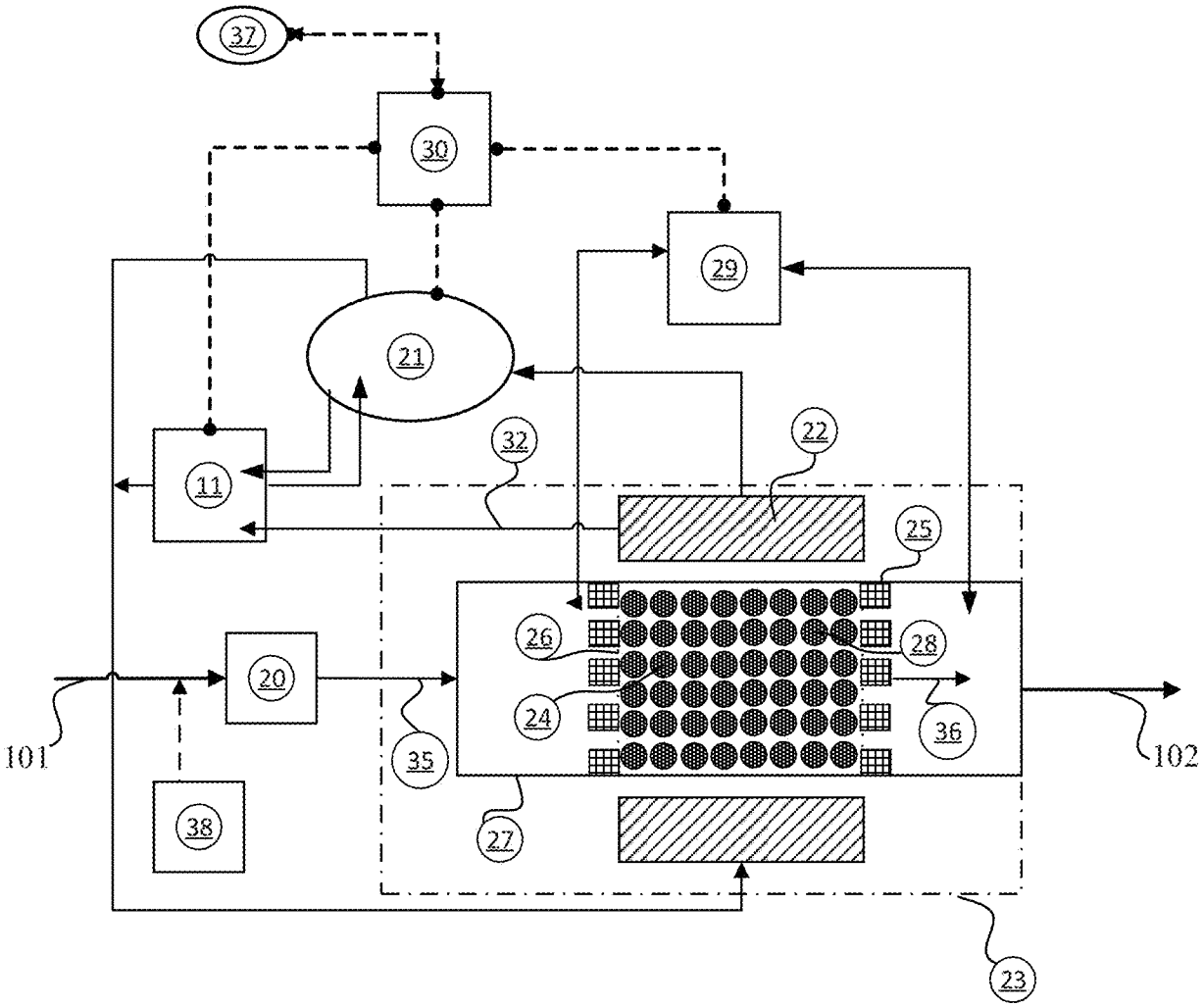
FIG. 2 is a general diagram of the induction system shown in FIG. 1.
Figure 3:
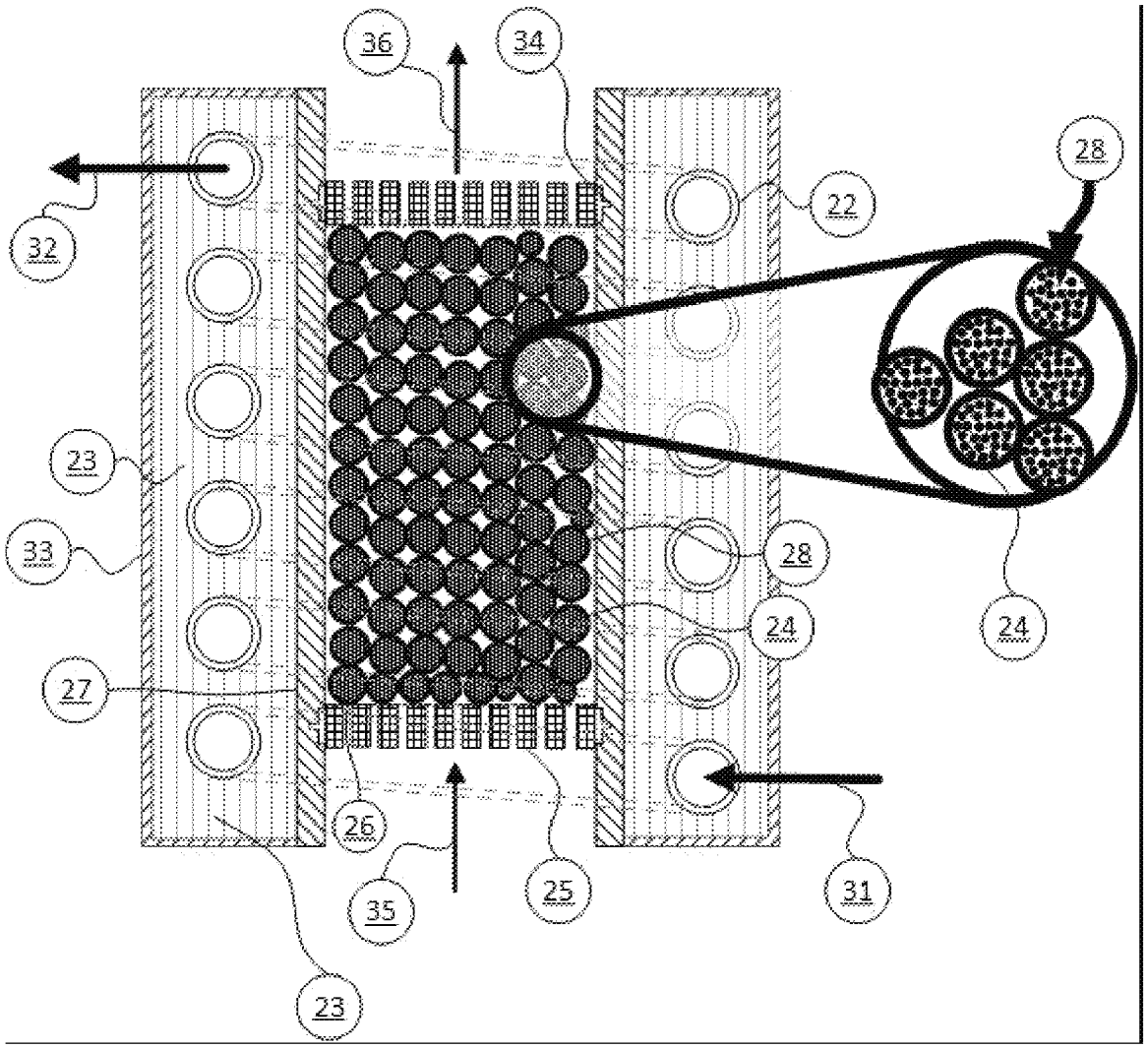
FIG. 3 is a cross-sectional detailed view of the induction system shown in FIG. 2.
Figure 4:
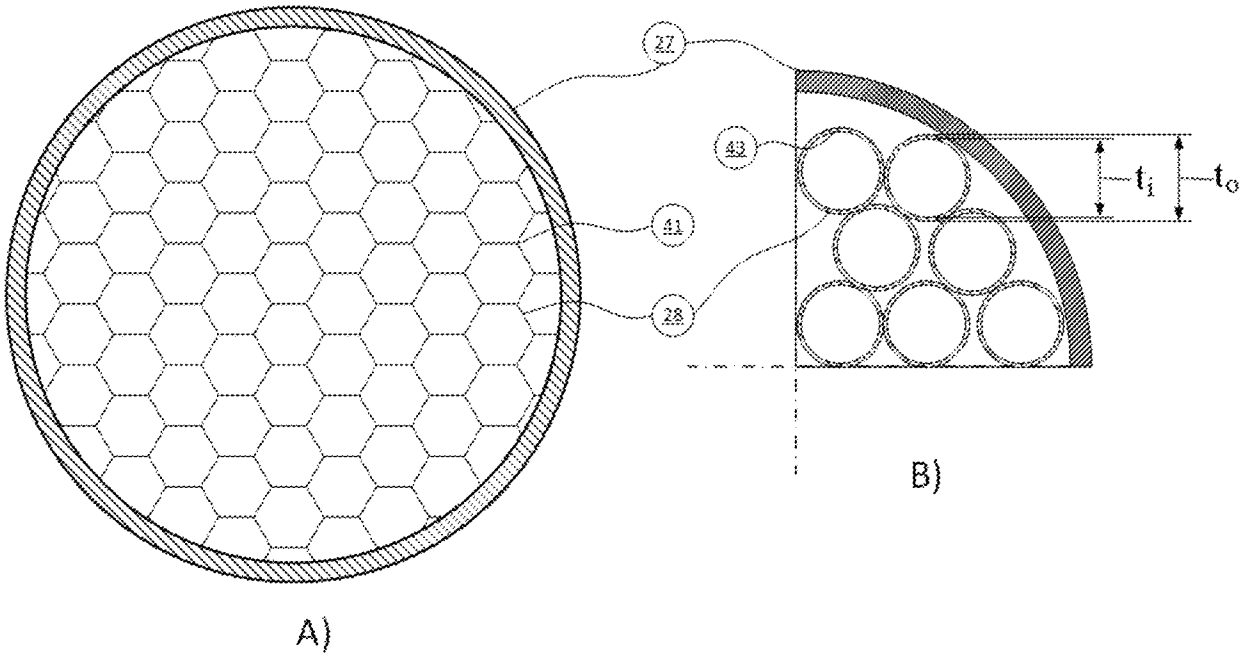
FIG. 4 depicts example alternate induction heating structures that can be used in embodiments of the present invention.
Figure 5:
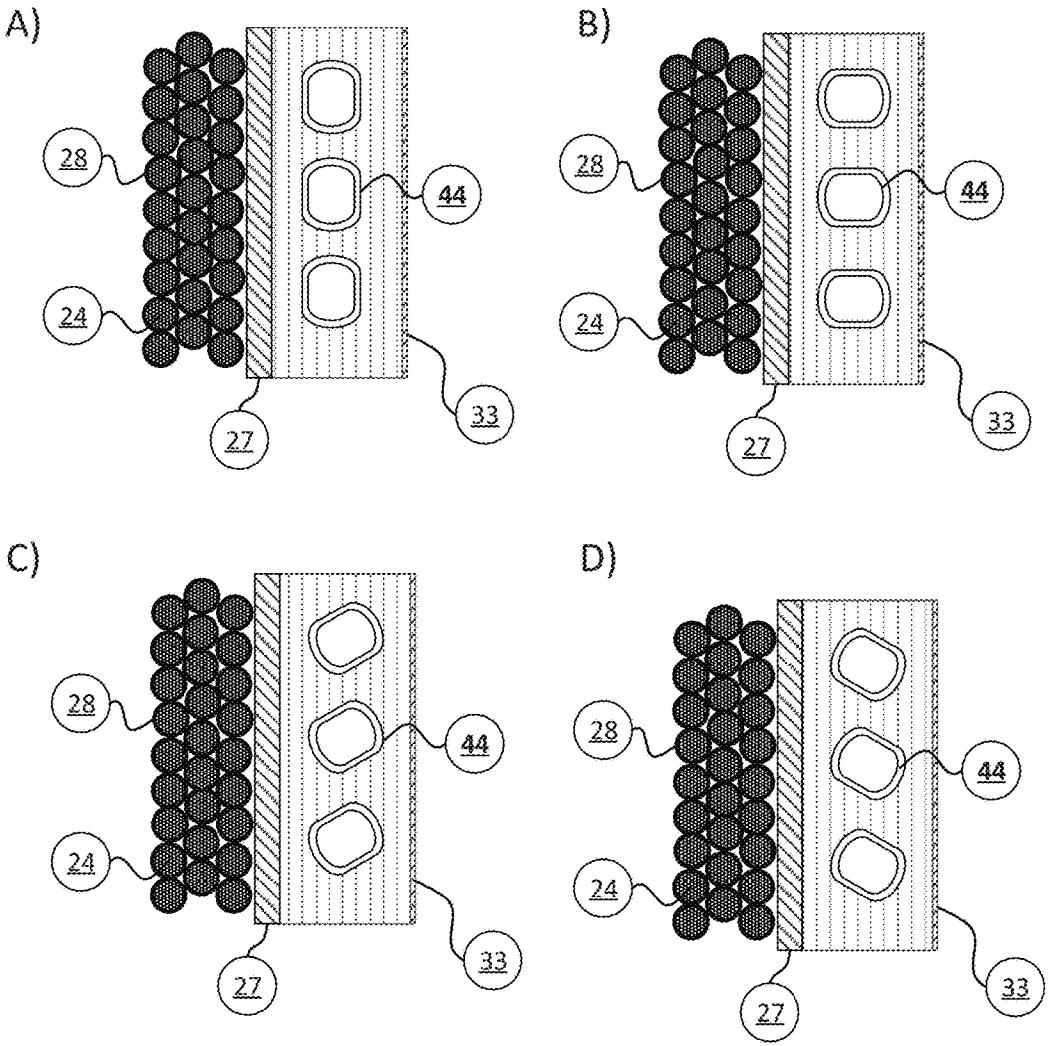
FIGS. 5A-5D depict configurations and variations of the induction coil, according to alternative embodiments of the invention.

Within the other components in 2, there is a component that is a structure that comprises one or various subdivisions or structures made of an electrically non-conductive or low-conductive material. The electrically non-conductive or with low conductivity material is filled with particles in the size range of micrometers or millimeters or nanometers with superparamagnetic characteristics. These objects with superparamagnetic or magnetic particles are referred from now on as "induction heating structure 24". The induction heating structure can be in the form of spheres 24 as shown in FIG. 2 and FIG. 3; irregular geometries as shown in FIG. 4; other configurations and arrangements as in honeycombs 41 or for example tightly packed hollow cylinders 43. The induction heating structures 24 and similar are kept in place by a retainer 25 (FIG. 2, FIG. 3). A holding structure in the shape of a mesh 26, if necessary, is used to keep in place and avoid displacement of the induction heating structure 24, 41, 43, or similar arrangements out of the electrically non-conductive, or low-conductive material.

The induction heating structure in 24 (FIG. 2 and FIG. 3), and their variations shown in FIG. 4 are, if needed, covered on their surface by a catalyst as an example, metallic or polymeric catalyst, or the mixture of one or both components 28; this is chosen as means to increase the chemical reaction rate at the surface of the induction heating structures.

Components 24, 25, 26 and 28 are placed within a tube, pipe or other annular elongated structure 27 that is from now referred as well as "main casing 27", which is positioned concentrically with an induction coil 22 as it is shown in FIG. 2 and FIG. 3. The main casing can be manufactured with an electrically non-conductive or low-conductive material, such as, for example, glass, ceramic, special metallic alloys, metal oxides, or the mixture of one or many of these materials.

FIG. 2 shows additional components that are part of the induction system; for example: a temperature and pressure measurement system that acquires data through probes or other measuring devices 29 which monitor process conditions and communicate with the process control system 30 as shown with the dashed lines.

The fluid current 101 as seen in FIG. 1 and FIG. 2 passes through a fluid-handling device 20, as means of modifying the flow pattern by changing the local Reynolds number with the goal of improving mixing at the entrance of 27. Optionally, the same stream or current could mix with another stream or current supplying hydrogen 38 before entering 20. The current 35 at the exit of step 20 that enters main casing 27 is mixed if necessary with the current 38 on FIG. 3. The current of fluid that has experienced thermal exchange through the items 24 that has passed through the induction heating system is called 36.

FIG. 3 shows in greater detail the parts and structures specific to the present invention; herein described as the heat transfer to the fluid by means of magnetically induced structures that contain superparamagnetic or magnetic material. Here, the induction coil 22 is hollow in the interior, allowing the flow of cooling liquid that originates in 11. The cooling liquid enters the induction coil 22 at 31, flowing through it, and later exiting the coil 22 as stream or current 32 at a higher temperature than the current 31 at the entrance. The current 32 is directed towards 11 to lower its temperature and/or is discarded from the system if necessary.

In certain embodiments, the cooling fluid can be used in 11 (FIG. 2) as a means to control a temperature of the circuitry in the power supply unit 21, to maintain proper operating temperature. In FIG. 2, the dashed lines show communication between 11, 21, 29 and the control system 30 with pointers at both ends.

The control system 30 shown in FIG. 2 communicates with 11, 21 and 29 as part of the functions of receiving, processing/transmitting information, orders, or a combination of them; the system is also capable of bi-directional communication and control of peripheral systems and sensors outside the circuit as shown in 37 by the dashed lines with pointers at both ends.

The fluid stream 102 corresponds to the liquid or fluid that has passed the heating system 2 by magnetic induction described in the previous paragraphs. The temperature or internal energy of this stream is increased by means of thermal exchange at the surface of the induction heating structure 24 (and variants shown in FIG. 4).

In FIG. 3, a heating apparatus 2 by means of induction is shown in greater detail and comprises a small portion of all the elements shown in FIG. 2. This figure (FIG. 3) also shows a cross-sectional view of induction coil 22 clearly identified, including the annular section where the cooling fluid enters at 31 and leaves the coil at 32. The insulating material 23 covers the induction coil 22, which can be in contact with the main casing 27 that surrounds the induction heating structure 24. The insulating material 23 is held in position by a protective cover 33. The induction heating structure 24 is held in position as well by retainer mechanism 25, which is in contact with main casing 27 via a holding piece 34 in such a way that allows for it to hold the induction heating structure 24, which will be described in more detail below.

A magnified or close-up section shown in FIG. 3 depicts a portion of the induction heating structure 24 in greater detail. This structure includes several spheres containing superparamagnetic or magnetic material within their surface boundary. The spheres size distribution could be monodisperse, bidisperse and polydisperse and, therefore, the volume distribution of said spheres varies. Moreover, in this figure, a catalyst positioned at each individual part is shown in greater detail at 28. The retainer of the induction heating structure is shown at 25, where the holding equipment is kept in position by direct contact with the main casing 27, by spacers or holding beams, or a combination of both; these spacers and beams can be located internally or about the exterior of main casing 27. The holding structures 25 used to hold the induction heating structure 24, which might be necessary or not, are positioned between 27 and 24.

Now possible variations, alterations and/or modifications according to embodiments of the present invention are discussed. FIG. 4 shows a cross sectional view of the main casing section 27 and of an induction heating structure. Here alterations or modifications to the morphology of the induction heating structure are seen as hexagonal arrangements 41. A different configuration of the induction heating structure is shown to have an array of tightly packed hollow cylinders. The cylinders are hollow along the larger axis, and could have one or several bores. They are thin walled and contain superparamagnetic or magnetic material 43. As mentioned before, this material responds to the stimuli of an alternating magnetic field. Therein similar to 24, the variations 41 and 43 could be covered by a catalyst material 28.

These cylinders are packed such that the external walls of each individual element are in contact to the neighboring one. The packing mechanism creates interstitial spaces where the fluid can pass through, and be in contact with the induction heating structure. This configuration reduces the pressure drop of the fluid through the induction heating apparatus, allowing similar or greater surface contact area when compared to the conventional packing with spheres.

FIGS. 5A-5D show a cross section of magnetic induction heating systems according to alternative embodiments. Here the induction coil has both different shapes and orientation than in FIG. 3. Here, the induction coil 44 has an oval shape; its rotation axis can be placed either vertically or horizontally as shown in FIG. 5-A and FIG. 5-B. The same coil may be positioned if desired in another angular configuration with respect to FIG. 5-A, as shown, for example, in FIG. 5-C and FIG. 5-D. The different configurations of the induction coil may allow improvement in heat transferred from the induction heating structure to the fluid by means of altering the direction of the magnetic field lines.

Figure 6:
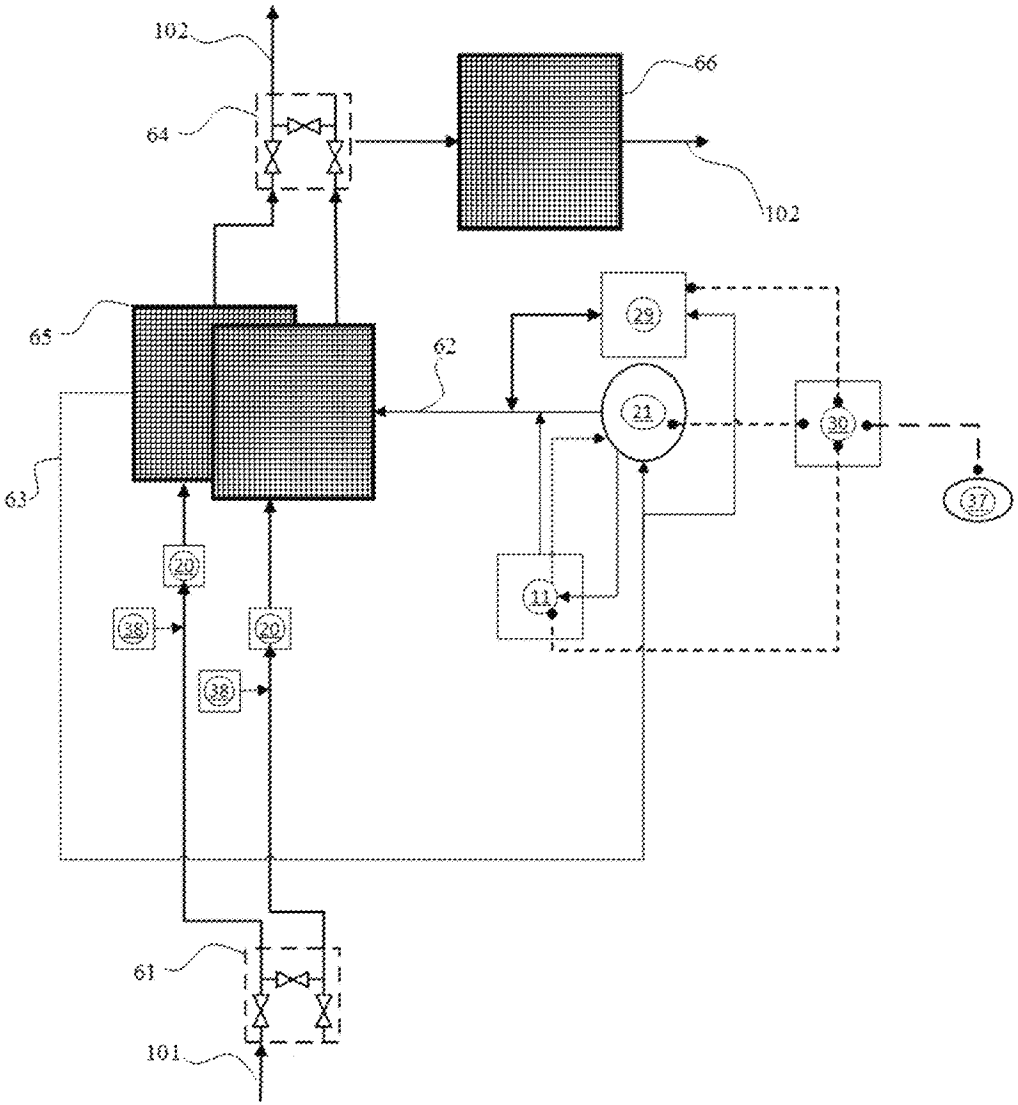
FIG. 6 is a general diagram of an induction system according to another embodiment of the invention.

FIG. 6 shows an alternative configuration of unit 2, specifically in the configuration of the parts of the heating apparatus by means of magnetic induction shown in FIG. 2. In FIG. 6 parts 65 and 66 show the grouped parts of the induction heating system mentioned in FIG. 2 as 22, 23, 24, 25, 26, 27, 28, 35. Part 65 may be reproduced and assembled according to demand, either in parallel or in series. At the inlet of the aforementioned grouped parts, are streams 20 and 38. Therein, stream 101, previous to entering 20, passes through an apparatus 61 of the valve type, fluid collector, or manifold, which directs the flow to each inlet port at 20. In FIG. 6, lines 62 and 63 are grouped to simplify the drawing at the entrance and exit of the induction heating system; these lines carry process information such as temperature, pressure, electric current and other variables originating at 11, 21, 29. Once the fluid leaves the part 65, it enters an apparatus or part 64 of the similar type as 61, and exits as stream 102.

According to embodiments, and referring back to FIG. 1, once the fluid leaves the magnetic induction heating apparatus of unit 2, the fluid may be diverted through stream 6, and/or passed through a heating vessel 3 known as soaker as means to increase the heating residence time to improve visbreaking.

Once a certain fluid volume is heated at the appropriate temperature under the required time for visbreaking, either by passing through solely through unit 2 in FIG. 1 or also through unit 3 known as soaker drum in FIG. 1, the fluid is transported to a heat exchange type apparatus unit 4 in FIG. 1 as a step for stopping the visbreaking process. This step is called quenching; here the nominal fluid temperature is reduced below the visbreaking temperature effectively stopping or halting the visbreaking reactions.

After the quenching step, the fluid is moved outside of the system previously described; the fluid now may be transported in pipelines, lorries, tankers and barges. Moreover, during or previous the transport process the oil could be mixed with a solvent as means of further reducing the viscosity. If necessary the fluid could also be stored or separated through other specific means 5, described above.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims, it is expressly intended that the provisions of 35 U.S.C. § 112(f) are not to be invoked unless the specific terms "means for" or "step for" are recited in a claim.

What is claimed is:

1. A visbreaking system comprising a packed-bed heating apparatus or reactor wherein a fluid temperature therein is increased using the packed-bed heating apparatus through induction heating, and wherein the packed-bed heating apparatus contains materials selected from the group consisting of superparamagnetic materials, paramagnetic materials, ferromagnetic materials, and combinations thereof.

2. A heavy oil induction heating apparatus in which a fluid flowing therethrough is heated to a specific temperature such that a visbreaking phenomena occurs, the apparatus comprising:

A) an electrical power source that generates an alternating current of high frequency;

B) a magnetic induction heating coil wherein the current emanated by A) flows;

C) an electrically non-conductive annular casing comprising a tube, or a pipe, wherein the casing has a fluid entrance port and a fluid outlet port; and D) between said ports, an induction heating structure responsive to the magnetic field produced in B), wherein said induction heating structure is formed of independently moving parts, solid parts, or a combination of both, selected from the group consisting of superparamagnetic materials, paramagnetic materials, ferromagnetic materials, and combinations thereof.

3. The apparatus of claim 2, wherein the parts of the heating structure contain particles which respond according to the Neel relaxation phenomenon to induce heating of the fluid.

4. The apparatus of claim 3, wherein the heating structure further comprises a catalyst deposited on a surface of the parts.

5. The apparatus of claim 2, wherein the casing of C) that contains induction heating structure of D) is concentric to the induction heating coil.

6. The apparatus of claim 2, further comprising:

materials positioned such that the induction heating structure of D) is held in place within the casing of C).

7. The apparatus in claim 2, further comprising an insulating material or jacket placed between the induction coil and the casing of C).

8. The apparatus of claim 7, wherein the insulating material extends radially to a distance from the casing of C), which is surrounded by another casing or sheath such that the insulating material is held in place between the casing of C) and the other casing or sheath, sandwiching the induction coil therebetween.

9. A process for the partial or total improvement of heavy oil and hydrocarbons by visbreaking, the process comprising:

introducing the heavy oil or hydrocarbons into the system of claim 1.

10. A process for the partial or total improvement of heavy oil and hydrocarbons by visbreaking, the process comprising:

introducing the heavy oil or hydrocarbon into the apparatus of claim 2.

11. The process of claim 10, wherein the process allows a substantially uniform control of a fluid temperature, therein reducing production of petroleum coke.

12. A visbreaking system comprising a packed-bed heating apparatus or reactor wherein a fluid temperature therein is increased using the packed-bed heating apparatus through induction heating comprising:

a plurality of apparatuses of claim 2 positioned in series or in parallel.

* * * * *